US005851132A

United States Patent [19]

Merrill

[11] Patent Number: 5,851,132

[45] Date of Patent: Dec. 22, 1998

[54] KAYAK PADDLE WITH ROTATING HANDLES

[76] Inventor: Lawrence E. Merrill, 26 Columbia St., Bangor, Me. 04401

[21] Appl. No.: 990,204

[22] Filed: Dec. 13, 1997

[51] Int. Cl.[6] ..... B63H 16/04

[52] U.S. Cl. ..... 440/101; 416/74; D12/215

[58] Field of Search ..... 440/101, 102, 440/103; 416/74; D12/215; 441/56; 114/347

[56] References Cited

U.S. PATENT DOCUMENTS 4,673,361 6/1987 Harvey ..... 440/101
4,701,142 10/1987 Merritt ..... 440/101

FOREIGN PATENT DOCUMENTS 2209723 5/1989 United Kingdom ..... 440/102

OTHER PUBLICATIONS

The Widgeon, by Marc F. Pettengill, published in Wooden-Boat Sep.–Oct. 1996, No. 132, pp. 89–91.

*Primary Examiner*—Jesus D. Sotelo

[57] ABSTRACT

An improved kayak paddle for recreational or competitive paddling, which has handles affixed perpendicular to the shaft or shafts, which handles rotate on axles as the paddle is used, to reduce twisting of the wrists and other joints of the paddler and improve efficiency and comfort. The shape of the paddle blades is such that water falls off the corner of the blades and does not run down the shaft to wet the hands of the paddler.

2 Claims, 2 Drawing Sheets

KAYAK PADDLE WITH ROTATING HANDLES

BACKGROUND

1. Field of Invention.

This invention relates to kayak paddles, particularly those constructed for use in recreational and competitive kayak paddling.

2. Description of Prior Art.

Kayak paddles have been known for many years. Such devices have consisted of a single elongated shaft and two flattened blade portions, which may be either integral with the shaft or attached thereto. On some paddles the blades are feathered, meaning the planes of the blades are oriented in perpendicular or nearly perpendicular relation to each other, while on non-feathered paddles the blades reside in the same plane. The paddle is usually made of some suitably rigid material such as wood, aluminum, plastic, or the like. Light weight and strength to resist the forces imposed upon them are important considerations in the manufacture of paddles.

In using a traditional kayak paddle one grips the shaft with both hands, parallel to the longitudinal axis. The blade is inserted in the water near the side of the boat at a point in front of the user. The blade is then pulled backward approximately parallel to the boat, by backward pressure exerted through the hand closest to the blade in the water, while forward pressure is exerted through the other hand. When the blade has been pulled back to a point beside or just behind the user, it is removed from the water with an upward motion and the opposite blade is inserted in the water in front of the user. The sequence of motions is repeated, creating forces which propel the boat forward through the water. Subtle differences in the amount of force applied and the direction in which it is applied with each stroke are used to steer the boat and keep it on course.

As the sequence of motions is repeated, particularly with feathered blades, the paddle is twisted and rotated between insertions of blades in the water to optimize the angle for exertion of force. This causes the paddle to slip in the hands of the user, which can cause irritation and blistering, particularly in the area between the thumb and forefinger. It also forces the wrist and elbow to flex with each stroke, which causes stress in these joints. The overall result of the twisting and rotating of the paddle is a gradual loss of efficiency in paddling as fatigue and soreness increase.

As noted above, both hands are placed on the shaft parallel with the longitudinal axis when using a traditional kayak paddle. There is no perpendicular handle as there would be with a typical canoe paddle. It is recognized that the perpendicular handle is of substantial assistance to the canoe paddler, allowing him to apply force more efficiently with each stroke.

On a few kayak paddles, two handles are set approximately perpendicular to the axis of the shaft. This gives the paddler something comparable to the perpendicular handle on a canoe paddle, allowing him to make more powerful and efficient strokes. This was a significant feature in U.S. Pat. No. 4,673,361 to Harvey, Jun. 16, 1987. However, since the handles on these kayak paddles are fixed, they do not reduce the amount of twisting and turning of the wrists required with each stroke.

When traditional kayak paddles are used, water tends to run down the shaft from the blade that is elevated at a particular moment and wet the hands of the paddler. This is sometimes prevented by using drip rings made of rubber or similar materials, which encircle the paddle shaft and deflect the water. Drip rings are typically an extra feature and add weight to the paddle.

OBJECTS AND ADVANTAGES

Accordingly, it is a principal object of the present invention to remove the necessity for much of the twisting and turning of the paddle, by means of rotating handles provided as an integral part of the paddle, which will overcome the shortcomings of the conventional kayak paddle, and further improve on the fired handles which are the subject of U.S. Pat. No. 4,673,361 to Harvey, Jun. 16, 1987. On the improved kayak paddle, there are two handles set approximately perpendicular to the axis of the shaft or shafts, and the handles rotate on axles as the paddle is used. The rotation of the handles, which is both clockwise and counterclockwise at different phases of the stroke, significantly reduces the twisting and stress on the wrists and other joints of the paddler, allowing him to paddle much farther with greater comfort and efficiency.

Another object is to create a paddle which can be produced relatively easily and inexpensively.

Another object is to produce a paddle which tends to prevent water from running down along the shaft to wet the hands of the paddler.

A paddle construction according to the invention provides a double bladed kayak paddle enabling both hands to grip perpendicular handles to substantially increase the strength and efficiency of the paddle stroke.

In addition, the perpendicular handles rotate in use, to reduce the amount of twisting and stress on the wrists and other joints of the paddler.

As an additional feature, the blades are shaped in such a manner that the lower corner collects water as it runs off the blade and causes it to drip off that corner and not run along the paddle shaft to wet the hands of the paddler.

Figure 1:
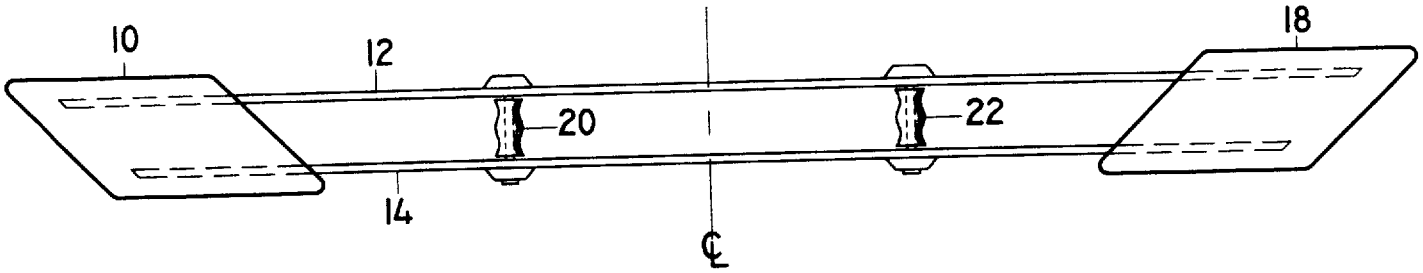
FIG. 1 is a side view of an improved kayak paddle according the first embodiment of the invention.

| REFERENCE NUMERALS IN DRAWINGS | |
|---|---|
| 10 left blade | 12 upper shaft |
| 14 lower shaft | 18 right blade |
| 20 left rotating handle | 22 right rotating handle |
| 24 bolt | 26 low friction bearing |
| 28 low friction bearing | 30 retaining nut |
| 40 left blade | 42 single shaft |
| 44 left rotating handle | 46 right rotating handle |
| 48 right blade | |

DESCRIPTION—FIGS. 1 THROUGH 4

Making reference to the drawings, an improved kayak paddle according to a first embodiment comprises an elongated upper shaft of round or other suitable cross section 12 and an elongated lower shaft of round or other suitable cross section 14 extending between and affixed to one paddle blade 10 and another paddle blade 18. Two handles which are capable of rotating 20 and 22 are affixed to shaft 12 and shaft 14 in a perpendicular manner separated by a distance which is comfortable for the user of the paddle, taking into account the length of his arms and position in which he prefers to hold them. All of these components reside in essentially the same plane. The size of the components could vary depending on the size, strength and perceived needs of the paddler.

Figure 2:
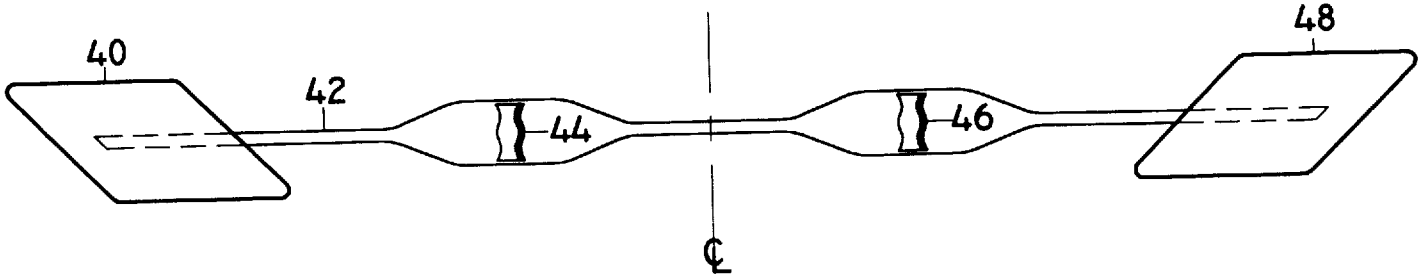
FIG. 2 is a side view representing a second embodiment of the invention.
Figure 3:
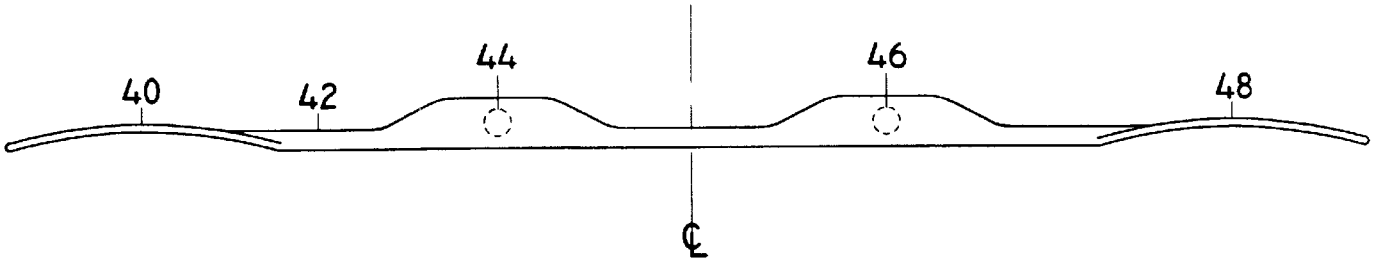
FIG. 3 is a top view of the kayak paddle of FIG. 2.

In a second embodiment illustrated in FIG. 2, an improved kayak paddle comprises a single elongated shaft of U-shaped or V-shaped cross section of varying dimensions 42 as clearly shown in FIGS. 2 and 3. Thus, the top view of FIG. 3—in comparison with the side view of FIG. 2—shows enlarged handle-receiving shaft portions centrally located and extending between and affixed to one paddle blade 40 and another paddle blade 48. Two handles which are capable of rotating 44 and 46 are affixed to shaft 42 in a perpendicular manner at a point on the shaft where the sides of the shaft are located at a distance from each other just exceeding the length of the handles.

FIG. 3 is a top view of the same improved kayak paddle shown in FIG. 2. It gives another view of the handles and indicates that the paddle shaft would be enlarged enough to allow the hands of the paddler to rest on the handles and still rotate freely without touching the shaft 42.

Figure 4:
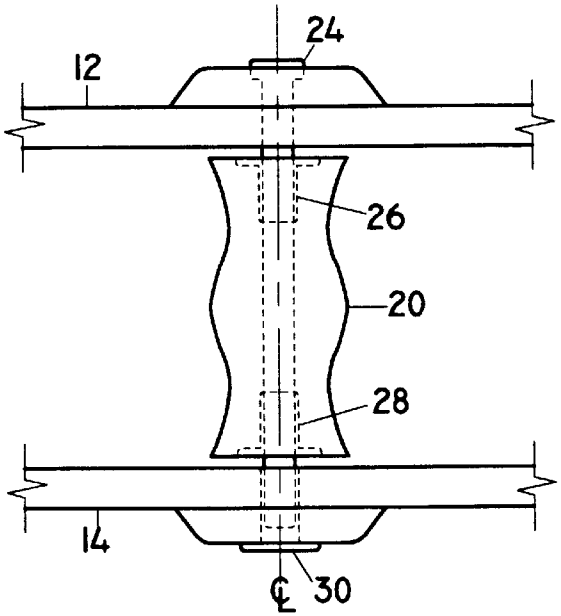
FIG. 4 is an enlarged view of an embodiment of one of the rotating handles as shown in FIG. 1, FIG. 2 and FIG. 3.

FIG. 4 is an enlarged view of handle 20, which is similar to handles 22, 44 and 46. It shows that the handle is attached to upper shaft 12 and lower shaft 14 at approximately a 90 degree angle. Bolt 24 connects the handle 20 to the shafts, and also serves as axle for rotation of the handle. Retaining nut 30 holds bolt 24 in place. Low friction bearings 26 and 28 permit handle 20 to turn freely on bolt 24, both clockwise and counter-clockwise. The bearings used are made of plastic, though other materials might be suitable.

Several other embodiments of improved kayak paddle handle 20 are possible. It can be constructed from wood, plastic, metal, rubber, or other suitable material, as long as it has enough strength to transmit the force provided by the paddler through the paddle to the water. Bolts or other fasteners can be made of metal, wood, plastic or other suitable material, as long as they will serve to connect handle to shaft and allow the handle to rotate freely. Depending on the materials used, separate bearings may not be necessary.

The blades and shafts can be made of wood, metal, plastic or other suitable material with an appropriate combination of strength and weight.

OPERATION—FIGS. 1 and 2

In using the improved kayak paddle shown in FIG. 1, the left hand grips handle 20 and the right hand grips handle 22. Blade 10 would be inserted in the water near the kayak, and handle 20 would be pulled back approximately parallel to the kayak by the left hand, while handle 22 was pushed forward by the right hand. The rotation of the handles would allow the wrists of the paddler to remain nearly straight and avoid twisting as the paddle was moved. When blade 10 reached a position beside or just behind the paddler's body, it would be removed from the water and blade 18 would be inserted in the water and handle 22 would be pulled back to propel the kayak forward. These strokes would continue on alternate sides of the kayak, using alternate blades, as long as forward progress was desired.

To cause the kayak to go backward, the strokes would be essentially reversed. Blade 10 would be placed in the water beside or behind the paddler's body. Handle 20 would be pushed forward as far as the paddler could comfortably reach, and then blade 10 would be removed from the water and blade 12 would be inserted on the other side of the kayak. It would be pushed forward by handle 22 and the cycle would continue as long as it was desired to go backward.

Because of the shape of the paddle blades 10 and 18, water would collect on their lower corners and fall off directly instead of running down the shaft to wet the hands of the paddler as would happen with a traditional paddle.

Using the improved kayak paddle shown in FIGS. 2 and 3 would be similar to using that shown in FIG. 1. The most significant difference is that the handles 44 and 46 would be enclosed on three sides by the sides of the shaft 42, which would give the hands of the paddler some protection from the elements.

SUMMARY RAMIFICATIONS AND SCOPE

Accordingly, the reader will see that the improved kayak paddle can be used more efficiently and comfortably than the traditional kayak paddle. Its rotating handles affixed in a perpendicular cross-axial fashion to the paddle shaft or shafts substantially reduce the twisting of the wrists and other joints of the paddler, and allow him to apply more power for a longer period of time with more comfort. In addition, the shape of the blades causes water to fall off the blade and not run down the shaft to wet the paddler's hands.

Several different materials can be used in constructing the improved kayak paddle, and they can be combined. For example, an improved kayak paddle could be made entirely of plastic, or entirely of wood, or it could have wooden shafts and plastic blades, or it could have metal shafts and wooden blades, or other combinations. The handles could be made from a number of different materials, and they could be secured by varied means as long as they were able to rotate as they were used.

The size of the blades, shafts, and handles, and their location in relation to each other, could change depending on the size, strength and perceived needs of the paddler.

Although the description above contains many specificities these should not be construed as limiting the scope of the invention but as merely providing illustrations of some of the presently preferred embodiments of this invention. For example, the shafts could be round, oblong, triangular, flattened, etc.; the handles could be round, oval, or specifically formed to fit the hand of the paddler, etc.

Thus the scope of the invention should be determined by the appended claims and their legal equivalents, rather than by the examples given.

I claim:

1. An integrally constructed kayak paddle comprising:

(a) a first paddle blade shaped with an acute angle or small radius at the lower interior corner thereof for assuring that water will collect at the lower interior corner and fall off from the corner instead of running down the shaft;

(b) a second paddle blade shaped with an acute angle or small radius at the lower interior corner thereof for assuring that water will collect at the lower interior corner and fall off from the corner instead of running down the shaft, oriented in the same plane;

(c) an upper shaft connecting the first paddle blade and the second paddle blade;

(d) a lower shaft connecting the first paddle blade and the second paddle blade;

(e) a handle to be held in the left hand of the paddler which runs between and is connected to the upper shaft and lower shaft perpendicular to the axes of the shafts and resides on an axle which allows it to rotate in place as the paddle is used;

(f) a handle to be held in the right hand of the paddler which runs between and is connected to the upper shaft and lower shaft perpendicular to the axes of the shafts and resides on an axle which allows it to rotate in place as the paddle is used.

2. An integrally constructed kayak paddle comprising:

(a) a first paddle blade shaped with an acute angle or small radius at the lower interior corner thereof for assuring that water will collect at the lower interior corner and fall off from the corner instead of running down the shaft;

(b) a second paddle blade shaped with an acute angle or small radius at the lower interior corner thereof for assuring that water will collect at the lower interior corner and fall off from the corner instead of running down the shaft, oriented in the same plane;

(c) a shaft connecting the first paddle blade and the second paddle blade, which has a U-shaped or V-shaped cross section of varying dimensions, with the largest dimension being large enough to allow handles to be affixed to the sides thereof; and the smallest dimension being only large enough to provide adequate support for the paddle blades;

(d) a handle to be held in the left hand of the paddler which runs between and is connected to the upper and lower edges of the shaft perpendicular to the axis of the shaft and resides on an axle which allows it to rotate in place as the paddle is used;

(f) a handle to be held in the right hand of the paddler which runs between and is connected to the upper and lower edges of the shaft perpendicular to the axis of the shaft and resides on an axle which allows it to rotate in place as the paddle is used.

* * * * *